US009726172B2

(12) United States Patent
Wattellier et al.

(10) Patent No.: US 9,726,172 B2
(45) Date of Patent: Aug. 8, 2017

(54) ROTARY-OSCILLATING SUBASSEMBLY AND ROTARY-OSCILLATING VOLUMETRIC PUMPING DEVICE FOR VOLUMETRICALLY PUMPING A FLUID

(71) Applicant: EVEON, Montbonnot Saint Martin (FR)

(72) Inventors: Arnaud Wattellier, Eybens (FR); Christophe Dehan, Saint Ismier (FR)

(73) Assignee: EVEON, Montbonnot Saint Martin (FR)

( * ) Notice: Subject to any disclaimer, the term of this patent is extended or adjusted under 35 U.S.C. 154(b) by 305 days.

(21) Appl. No.: 14/423,935

(22) PCT Filed: Jul. 21, 2014

(86) PCT No.: PCT/FR2014/051869
§ 371 (c)(1),
(2) Date: Feb. 25, 2015

(87) PCT Pub. No.: WO2015/011384
PCT Pub. Date: Jan. 29, 2015

(65) Prior Publication Data

US 2015/0219099 A1 Aug. 6, 2015

(30) Foreign Application Priority Data

Jul. 22, 2013 (FR) ..... 13 57185

(51) Int. Cl.
*F04B 7/00* (2006.01)
*F04C 13/00* (2006.01)
(Continued)

(52) U.S. Cl.
CPC ..... *F04C 13/001* (2013.01); *F04B 7/04* (2013.01); *F04B 7/06* (2013.01); *F04B 9/047* (2013.01);
(Continued)

(58) Field of Classification Search
CPC .. F04B 7/06; F04B 7/04; F04B 53/143; F04B 9/047; F04B 19/22
(Continued)

(56) References Cited

U.S. PATENT DOCUMENTS 3,168,872 A 2/1965 Pinkerton
5,032,067 A * 7/1991 Progl ..... F16N 13/14 184/33
(Continued)

FOREIGN PATENT DOCUMENTS

CN 201103536 Y 8/2008
CN 102812248 A 12/2012
(Continued)

*Primary Examiner* — Charles Freay
*Assistant Examiner* — Christopher Bobish
(74) *Attorney, Agent, or Firm* — Ware, Fressola, Maquire & Barber LLP

(57) ABSTRACT

A rotary oscillating sub-assembly for positive displacement pumping of a fluid, said sub-assembly comprising: a hollow body defining a cavity having a wall with two ducts passing therethrough; a piston co-operating with said cavity to define a working chamber and including a channel that opens out longitudinally into said working chamber, said piston being movable angularly so as to put said working chamber into fluid-flow communication with one, then none, then the other of said ducts, and being movable in longitudinal translation to reciprocate so as to cause the volume of said working chamber to vary and successively suck in and then discharge said fluid, said piston carrying a sealing gasket that is formed of at least a sealing ring, a sealing half-ring, and at least one sealing strip that longitudinally connects said sealing ring to said sealing half-ring.

9 Claims, 5 Drawing Sheets

(51) Int. Cl.

| | |
|---|---|
| ***F04B 7/04*** | (2006.01) |
| ***F04B 9/04*** | (2006.01) |
| ***F04B 7/06*** | (2006.01) |
| ***F04B 53/02*** | (2006.01) |
| ***F04B 53/14*** | (2006.01) |
| ***F04C 2/00*** | (2006.01) |
| ***F04C 9/00*** | (2006.01) |
| ***F04C 15/00*** | (2006.01) |
| ***F04C 15/06*** | (2006.01) |
| *F04B 19/22* | (2006.01) |

(52) U.S. Cl.
CPC ..... *F04B 53/02* (2013.01); *F04B 53/143* (2013.01); *F04C 2/00* (2013.01); *F04C 9/007* (2013.01); *F04C 15/0003* (2013.01); *F04C 15/0057* (2013.01); *F04C 15/064* (2013.01); *F04B 19/22* (2013.01)

(58) Field of Classification Search
USPC ..... 417/500; 74/57
See application file for complete search history.

(56) References Cited

U.S. PATENT DOCUMENTS

| | | | | | |
|---|---|---|---|---|---|
| RE34,114 | E * | 10/1992 | Lindner | F04B 7/06 | 417/500 |
| 5,158,441 | A * | 10/1992 | Aid | F04B 7/06 | 417/500 |
| 5,385,992 | A * | 1/1995 | Koskinen | B01J 8/002 | 526/79 |
| 5,472,320 | A * | 12/1995 | Weisbrodt | F04B 7/06 | 417/326 |
| 5,494,420 | A * | 2/1996 | Mawhirt | F04B 7/06 | 417/499 |
| 5,601,421 | A * | 2/1997 | Lee | F04B 7/06 | 417/492 |
| 5,961,303 | A * | 10/1999 | King | F04B 7/06 | 417/492 |
| 2008/0187449 | A1 * | 8/2008 | Breidenbach | F04B 7/06 | 417/499 |

FOREIGN PATENT DOCUMENTS

| | | |
|---|---|---|
| DE | 3630528 A1 | 3/1988 |
| GB | 122629 A | 7/1919 |

* cited by examiner

ROTARY-OSCILLATING SUBASSEMBLY AND ROTARY-OSCILLATING VOLUMETRIC PUMPING DEVICE FOR VOLUMETRICALLY PUMPING A FLUID

CROSS REFERENCE TO RELATED APPLICATIONS

This application is the U.S. National Stage of International Application Number PCT/FR2014/051869 filed on Jul. 21, 2014, which application claims priority under 35 USC §119 to French Patent Application No. 1357185 filed on Jul. 22, 2013. Both applications are hereby incorporated by reference in their entirety.

TECHNICAL FIELD

The invention generally relates to a rotary-oscillating sub-assembly and to a rotary-oscillating pumping device for positive displacement pumping of a fluid.

Background of the Invention

The use of positive displacement pumping devices is known for producing and/or reconstituting mixtures (liquid-solid or liquid-liquid mixtures) and/or administering fluids (by injection, infusion, orally, spray, ...), in particular for medical, cosmetic, veterinary applications. For these types of applications, accurate quantities of fluid need to be pumped in a controlled manner, e.g. towards a container, or in order to administer them directly to a patient via an injection or infusion device, or via any other suitable device.

In particular in the medical field, in a hospital context, in a care center, or at home, it is known to use devices of the "syringe pusher" and "cartridge device pusher" types, and also peristaltic pumps.

"Syringe pusher" type devices require the syringe to be filled beforehand. Filling is usually performed manually, and this operation is laborious, particularly since it requires specific precautions to be complied with in order to guarantee the integrity of the liquid and the safety of personnel.

"Cartridge pusher" type devices require the use of silicone to lubricate the body of the cartridge and thus to make sliding easier between the piston, generally made of elastomer, and the body of the cartridge, generally made of glass or of plastics material. The presence of silicone in direct contact with the fluid generates problems of stability for molecules while they are being stored in the cartridge prior to being used.

Peristaltic pumps are bulky and voluminous. In addition, the principle on which such peristaltic pumps operate requires them to have a flexible hose that prevents high pressure being reached. As a result of the flexibility of the hose, the volumetric efficiency (ratio of real flowrate divided by demanded flowrate) varies greatly with varying fluid outlet pressure, and quickly degrades metering accuracy without the help of an auxiliary sensor (e.g. a flowrate sensor). Thus, the working pressures of such peristaltic pumps are typically lower than 5 bars, thereby limiting their use with viscous liquids. Furthermore, that type of pump often generates miniscule bubbles of air in the fluid, which bubbles can have an unacceptable effect. Finally, the rapid aging of the mechanical properties of the hose poses problems of changes over time in the performance and/or the reliability of that type of pump. The same types of drawback are encountered with diaphragm pumps.

It is also possible to use check-valve pumps. However, fluid can then pass freely from the inlet duct to the outlet duct when the inlet is at a higher pressure than the outlet. Also, check-valve pumps do not offer the possibility of having a neutral position in which all fluid flow is prevented. Finally, they are not reversible.

It is also possible to use gear or lobe pumps. However, those types of pump present poor self-priming capacity and they retain large internal volumes of fluid, making them difficult to use for such medical, cosmetic, or veterinary applications.

Publications GE 122 629, DE 36 30 528, and U.S. Pat. No. 3,168,872 describe rotary-oscillating positive displacement pumping devices each comprising: a hollow body defining a cavity and having a wall with two ducts passing therethrough and opening out into the cavity; and a piston housed in the cavity in which it is movable angularly and in alternative axial translation so as to vary the volume of the working chamber that it defines together with the cavity. U.S. Pat. No. 3,168,872 particularly describes the piston including a flat that is suitable for being successively in communication with one of the ducts during an intake phase, then none of the ducts during a switching phase, then the other one of the ducts during a discharge phase, then once again none of the ducts during a new switching phase, and so on. Thus, the fluid may be sucked in via one of the ducts during the intake phase, stored in the working chamber during the switching phase, and then discharged via the other duct during the discharge phase. However, proper operation of the rotary-oscillating positive displacement pumping device requires good sealing between the piston and the cavity, and this requires tight manufacturing tolerances that are difficult to comply with without considerable production costs and/or significant friction that penalizes the energy efficiency of the rotary-oscillating positive displacement pumping device.

SUMMARY OF THE INVENTION

The object of the invention is to remedy those drawbacks by proposing a rotary-oscillating sub-assembly for positive displacement pumping and a rotary-oscillating positive displacement pumping device of manufacturing cost that is moderate, with a limited number of parts, that is reversible, that is accurate, that makes it possible to transfer viscous liquid even at high pressure, and that have a good fluid-flow and energy efficiency.

To this end, the invention provides a rotary-oscillating sub-assembly for positive displacement pumping of a fluid, said sub-assembly comprising a hollow body defining a cylindrical cavity of longitudinal axis and having a wall with at least two ducts passing therethrough and opening out radially into said cavity, a piston housed in said cavity with which it co-operates to define a working chamber and comprising, in its cylindrical surface, a kind of longitudinal channel or recess that opens out longitudinally into said working chamber, said piston being provided with a sealing gasket that is made of a material having a modulus of elasticity that is less than the moduli of elasticity of said piston and of said body, and that is carried by said piston, the gasket running beside said channel so as to guarantee leaktight sealing between said piston and said cavity, the piston being movable angularly so as to put said working chamber into fluid-flow communication with at least one, then none, then at least the other of said ducts, and being movable in longitudinal translation to reciprocate so as to cause the volume of said working chamber to vary and successively suck in and then discharge said fluid via one then the other of said ducts, said sub-assembly being characterized in that the piston comprises a first axial end remote from a second axial end, said second axial end being in contact with the working chamber, said sealing gasket is made up of a plurality of portions comprising a first sealing portion in the shape of a ring that extends around the cylindrical surface of the piston beside its first axial end, a second sealing portion in the shape of a half-ring that extends around the cylindrical surface of the piston beside its second axial end, the half-ring having two ends that are spaced apart from each other over the cylindrical periphery of the piston, and a third sealing portion that is formed by two sealing strips that extend axially over the outside surface of the piston respectively between a first end of the half-ring and the ring, and a second end of the half-ring and the ring; in that the two strips are angularly distinct from each other and each define:

a first sealing line that angularly borders said channel, said first sealing lines being spaced apart from each other by an angle containing said channel, that is greater than each of the angles between the edges of either one of the ducts, and that is less than each of the angles between the adjacent edges of either one of the ducts and of its corresponding duct;

and a second sealing line, each second sealing line being spaced apart from one of said first sealing lines by an angle that does not contain said channel, that is less than each angle between the edge of one duct and the adjacent edge of its corresponding duct, and that is greater than each angle between the opposite edges of either one of the ducts;

and in that the angle between each first sealing line from at least one of the second sealing lines, and containing said channel, is greater than the angle between the axially-opposite edges of the two ducts.

The basic idea of the invention is to provide a sealing gasket between the piston and the body, the sealing gasket having a particular shape that makes it possible to guarantee effective, sealing while limiting friction, so as to improve the energy efficiency and increase the flowrate accuracy of the rotary-oscillating sub-assembly.

The rotary-oscillating sub-assembly of the invention may advantageously present the following features:

the piston includes a peripheral groove that receives the sealing gasket, which peripheral groove is formed of at least one annular groove that receives the sealing ring, a semi-annular groove that receives the sealing half-ring, and a longitudinal groove that interconnects the annular groove and the semi-annular groove and that receives the sealing strip;

at least one of said sealing ring and annular channel extends longitudinally beyond said channel relative to said working chamber and beyond said ducts relative to said working chamber, and at least one of said sealing half-ring and semi-annular groove extends longitudinally at said end of said channel opening out into said working chamber and between said ducts and said working chamber;

in its periphery, the piston includes at least one closed recessed zone that is entirely surrounded by said sealing gasket, said recessed zone extending angularly so as to be facing one of the ducts when said channel is facing another duct, said longitudinal groove being formed of two arms, each extending between said channel and said recessed zone, and each arm receives one of said sealing strips so as to isolate said recessed zone from said channel in leaktight manner, in any longitudinal and angular position of said piston in said body;

the recessed zone extends over an angle that is less than each of the angles between adjacent edges of either one of the ducts and of its corresponding duct;

the piston includes at least one balancing lug that is provided in said channel and that extends radially so that its periphery bears against said cavity while allowing fluid to pass over its sides;

it includes at least first and second stages, each corresponding, in distinct manner, to a set of two ducts, to a working chamber, to a channel, and to a sealing gasket;

it includes at least a cam and a guide finger, one carried by said piston, the other by said body, and arranged to co-operate reciprocally so that turning said piston relative to said body causes:

over a first angular portion, said piston to move in axial translation relative to said body in a first direction;

over a second angular portion, said piston to be axially stationary relative to said body;

over a third angular portion, said piston to move in axial translation relative to said body in a second direction;

over a fourth angular portion, said piston to be axially stationary relative to said body;

said ducts, said sealing gasket, and said channel being arranged so that said ducts are closed during said second and fourth angular portions.

The invention extends to a device for positive displacement pumping of a fluid, the device being characterized in that it comprises drive means and a rotary-oscillating sub-assembly for pumping a fluid, and releasable mechanical coupler means for mechanically connecting said drive means to said piston in releasable manner. Thus, for applications in which microbiological control is important, the fluid-flow portion formed by the rotary-oscillating sub-assembly may be separated easily from the drive means so as to be sterilized and/or changed.

BRIEF DESCRIPTION OF THE DRAWINGS

The present invention can be better understood and other advantages appear on reading the detailed description of two embodiments given by way of non-limiting example and shown in the accompanying drawings, in which:

In FIGS. 13 to 20, elements that are similar to elements in the preceding figures are given the same reference numbers, plus 100.

DESCRIPTION OF THE EMBODIMENTS

The rotary-oscillating pumping sub-assembly of the invention may present a single-acting configuration having a single stage, described below as a first embodiment shown in FIGS. 1 to 11, or a multi-acting configuration having a plurality of stages, e.g. the double-acting configuration described below as a second embodiment shown in FIGS. 12 to 19.

With reference to FIGS. 6 to 11, the rotary-oscillating sub-assembly 1 in the first embodiment of the invention comprises a body 2 and a piston 3.

Figure 7:
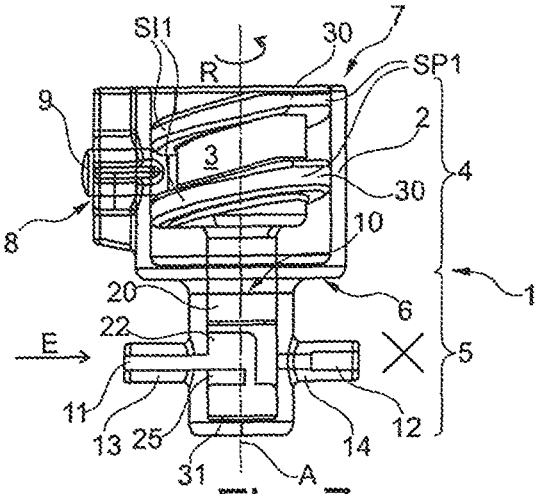

As shown in detail in FIG. 7, the body 2 is hollow and is formed of two cylindrical portions 4, 5 of different diameters, connected together via a shoulder 6. By way of example, the body 2 is made of plastics material or of any other suitable material.

The inside of the larger-diameter cylindrical portion 4 forms a bore 7 of longitudinal axis A. The free end of the larger-diameter cylindrical portion 4 is open and is for receiving the piston 3 in longitudinal sliding. The other end is connected to the smaller-diameter cylindrical portion 5 via the shoulder 6. The wall of the larger-diameter cylindrical portion 4 has an orifice 8 passing therethrough for receiving a radial guide finger 9 that is arranged so as to extend into the bore 7. In the embodiment shown, the guide finger 9 is a pin. The guide finger 9 may also be secured to the body by adhesive or by any other suitable means. By way of example, the guide finger 9 presents a cylindrical section or any other suitable section.

Figure 21:
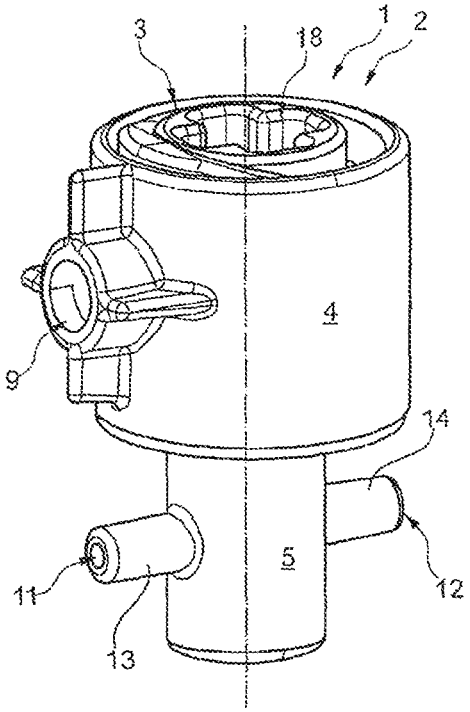
FIG. 21 is a perspective view of the body of the rotary-oscillating sub-assembly in FIGS. 1 to 11, showing the connector endpieces positioned at 180°.

The inside of the smaller-diameter cylindrical portion 5 defines a cavity 10 of longitudinal axis A and of diameter that is less than the diameter of the bore 7. The free end of the smaller-diameter cylindrical portion 5 is closed and forms the bottom of the body 2. The bore 7 and the cavity 10 are for receiving the piston 3 housed in the body 2. The wall of the smaller-diameter cylindrical portion 5 has two ducts 11, 12 passing therethrough and opening out radially into the cavity 10. By way of example, the ducts 11, 12 have a section that is circular, present the same diameter, are diametrally opposite each other on the same axis, and are situated in the same radial plane that is perpendicular to the longitudinal axis A. Thus, in this embodiment the openings of the ducts 11, 12 into the cavity 10 are diametrally opposite each other on the same axis, and are situated in the same radial plane. As shown in particular in FIG. 21, the body 2 includes connector endpieces 13, 14 that individually surround each of the ducts 11, 12, and that are suitable for connecting to an intake pipe, or to a discharge pipe, or to any other suitable fluid-flow connection equipment. Thus, the connector endpieces 13, 14 are offset from each other by an angle of 180° As described below, and depending on the selected operating configuration, each of the ducts 11, 12 may be used equally well to admit or to discharge fluid.

In another embodiment (not shown), the ducts may be longitudinally offset a little relative to each other.

Figure 24:
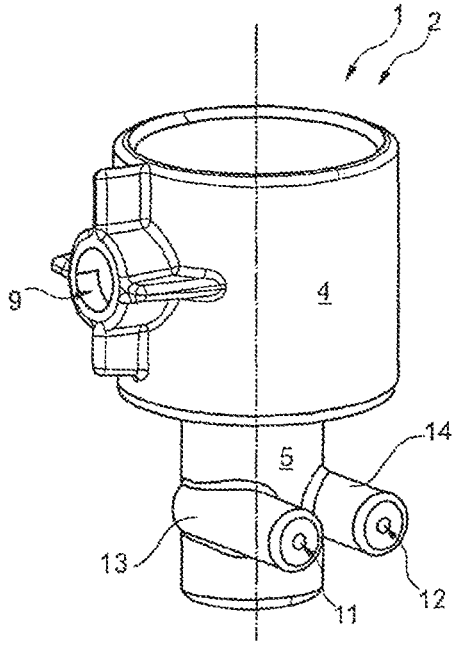
FIG. 24 is a perspective view of the body of a rotary-oscillating sub-assembly having endpieces that are parallel to each other.
Figure 25:
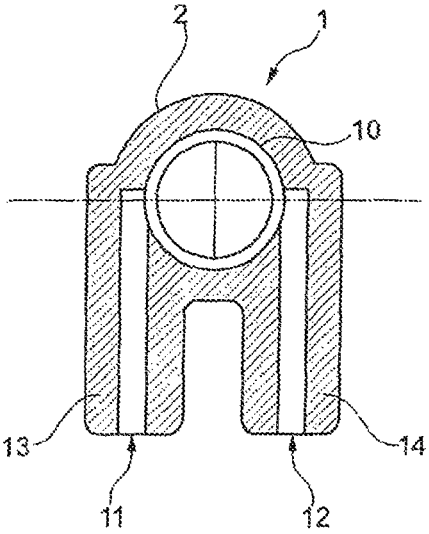
FIG. 25 is a radial section view in a plane that lies on the axes of the ducts of the body of the FIG. 24 rotary-oscillating sub-assembly.

In the embodiment shown in FIGS. 24 and 25, the openings of the ducts may be offset from each other by an angle of 180°, while each of the ducts 11, 12 has a bend that enables the endpieces to present an angle that is different from 180°. In this embodiment, the connector endpieces 13, 14 are parallel to each other, and this simplifies the configuration of fluid-flow connections. On the same principle, while having the openings of the ducts offset from each other by an angle of 180°, it is possible to have connector endpieces 13, 14 that present any other suitable angle between them. The same applies for duct openings that are offset by an angle other than 180°.

In another embodiment, the ducts may also be offset from each other by an angle other than 180°.

With reference in particular to FIGS. 1 to 5, the piston 3 is made up of two cylindrical portions 15, 16 of different diameters, connected together via a shoulder 17. By way of example, the piston 3 is made of plastics material or of any other suitable material.

The smaller-diameter cylindrical portion 16 of the piston 3 presents an outside diameter that is less than the diameter of the cavity 10, in which it may thus be housed. In the embodiment shown, the smaller-diameter cylindrical portion 16 of the piston 3 is made of two portions, namely a shaft 19 that is made integrally with the remainder of the piston 3 and that presents a reduction in diameter, and a sleeve 20 that is fitted on the reduced-diameter portion of the shaft 19, and that has an outside diameter that corresponds to the outside diameter of the shaft 19. The smaller-diameter cylindrical portion 16 of the piston 3 may also be made as a single piece.

Figure 1:
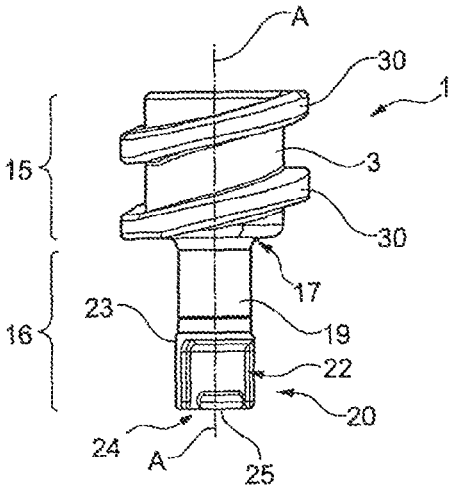
FIGS. 1 to 3 are front views of the piston carrying the sealing gasket of the rotary-oscillating sub-assembly in a first embodiment of the invention, shown in three different orientations.
Figure 4:
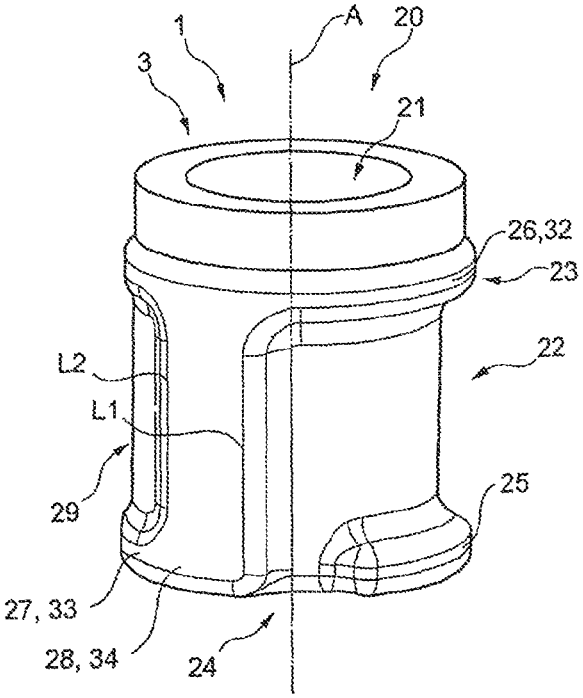
FIG. 4 is a perspective view of the sealing gasket in FIGS. 1 to 3, shown on its own.
Figure 2:
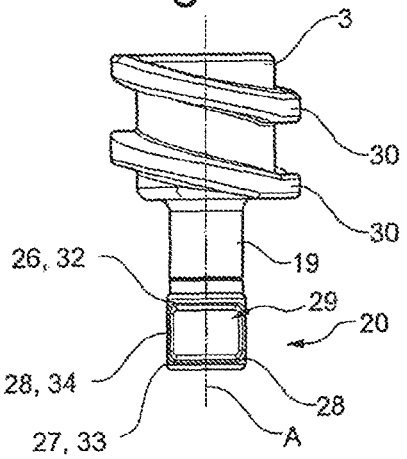
Figure 3:
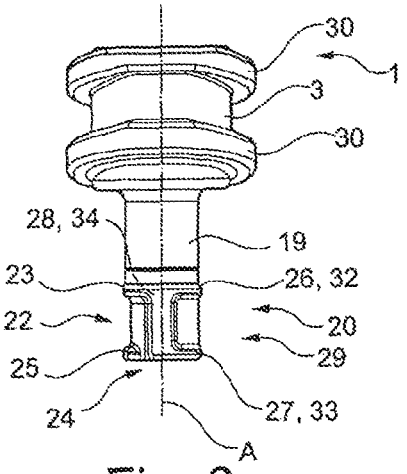

With reference to FIG. 4, the sleeve 20 includes an axial recess 21 and, by way of example, it is secured to the shaft 19 by force-fitting, optionally together with adhesive or any other suitable fastening means. Alternatively, the sleeve 20 may be made by being overmolded onto the shaft 19. With reference in particular to FIGS. 6 to 10, the free end of the sleeve 20 co-operates with the bottom of the body 2 to define working chamber 31 for receiving the fluid.

In its periphery, the sleeve 20 includes a channel 22 that extends longitudinally between a closed end 23 that is oriented towards the larger-diameter cylindrical portion 15 of the piston 3, and an open end 24 that opens out into the working chamber 31. In the embodiment shown, the bottom of the channel 22 presents a convex curved profile that is parallel to the longitudinal axis A. The profile may be different, e.g. flat with facets, a curved recess, or any other suitable profile. In the embodiment shown, the channel 22 is defined by longitudinal edges that are substantially parallel to the longitudinal axis A, and by transverse edges that are circularly arcuate, each of which is situated in a plane that is substantially perpendicular to the longitudinal axis A. The channel 22 thus generally presents the shape of a portion of a tube. The channel 22 may also present the shape of a sloping line, a cross, or any other shape adapted to the rotary-oscillating movement of the piston 3. At its open end 24, the sleeve 20 includes a balancing lug 25 that is provided in the channel 22 and that extends radially so that its periphery bears against the cavity 10 while allowing fluid to pass over its sides. By way of example, the balancing lug 25 is provided in the middle of the channel 22.

With reference in particular to FIG. 4, the sleeve 20 is provided with a peripheral groove made up of an annular groove 26, a semi-annular groove 27, and two longitudinal grooves 28 that interconnect the annular groove 26 and the semi-annular groove 27. In a variant embodiment (not shown), the sleeve includes a single longitudinal groove.

The annular groove 26 is recessed in a plane that is perpendicular to the longitudinal axis A, and lies axially beyond the closed end 23 of the channel 22 relative to the open end 24 of the same channel 22, and beyond the ducts 11, 12 relative to the working chamber 31 when the piston 3 is in the body 2, even when the piston 3 is in its low position.

The semi-annular groove 27 is recessed parallel to the annular groove 26 in a plane that is perpendicular to the longitudinal axis A, and lies axially at the open end 24 of the channel 22. Thus, even when the piston 3 is in its high position in the body 2, the semi-annular groove 27 is arranged axially between the ducts 11, 12 and the working chamber 31.

In the embodiment shown, the longitudinal grooves 28 are recessed parallel to the longitudinal axis A, and interconnect the annular groove 26 and the ends of the semi-annular groove 27. Thus, the channel 22 lies between firstly the longitudinal grooves 28, and secondly a portion of the annular groove 26. The longitudinal grooves 28 may also have a width that varies along the longitudinal axis A and, by way of example, presents an hourglass-shape.

In its periphery, the sleeve 20 also includes a closed recessed zone 29 that is angularly opposite the channel 22. Each longitudinal groove 28 is arranged between the channel 22 and the recessed zone 29. The recessed zone 29 thus lies between firstly the longitudinal channels 28, and secondly the semi-annular channel 27 and a portion of the annular channel 26. The recessed zone 29 makes it possible to limit the surface area of the piston 3 in contact with the cavity 10, and thus to limit friction. Thus, the rotary-oscillating movement of the piston 3 takes place with good energy efficiency.

The end of the smaller-diameter cylindrical portion 16 of the piston 3 opposite the working chamber 31 is connected to the larger-diameter cylindrical portion 15 of the same piston 3.

Figure 5:
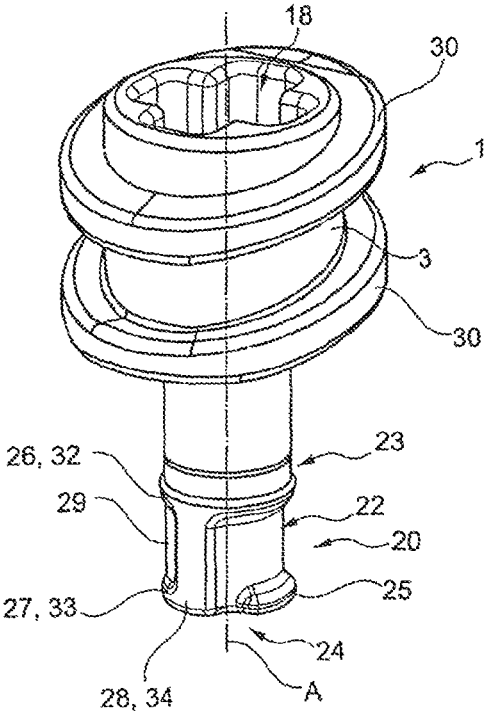
FIG. 5 is a perspective view of the end of the piston in FIGS. 1 to 3, carrying a sealing gasket.

The larger-diameter cylindrical portion 15 of the piston 3 presents an outside diameter that is less than the diameter of the bore 7 in which it may thus be housed. The free end of the larger-diameter cylindrical portion 15 presents a recessed shape 18 that is cross shaped (as can be seen in FIG. 5) for receiving an endpiece (not shown) of complementary shape, coupled to the drive means for turning the piston 3 relative to the body 2. The recessed shape 18 may have any other profile that is suitable for rotary drive, and it may also be provided as a portion in relief. However, a recessed shape presents the advantage of being less accessible, so the position of the piston 3 is thus less easily modified manually before using the rotary oscillating sub-assembly 1. Thus, as from its first use, the position of the piston is known, thereby making it possible to guarantee its operating phase at start-up (intake, switching, discharge), and thus to know accurately the dose transferred. For the same reason, the recessed shape may be designed so as to require the use of a specific tool in order to be maneuvered. The larger-diameter cylindrical portion 15 of the piston 3 includes two annular ribs 30 that are parallel to each other so as to define between them a dual guide cam for guiding the guide finger 9. Thus, at any point of turning relative to the guide finger 9, the longitudinal spacing between the annular ribs 30 is adjusted to the dimensions of the guide finger 9, so as to allow guidance without clearance or without excessive clearance. The guide finger 9 may also be provided with a turning portion for rolling over the annular ribs 30, thus reducing friction. Energy efficiency is thus optimized. Each of the annular ribs 30 includes first and second sloping portions SI1, SI2 that are symmetrical to each other about a longitudinal midplane. The first and second sloping portions SI1, SI2 thus present opposite slopes at the periphery of the piston 3. The first and second sloping portions SI1, SI2 are spaced apart from each other by first and second plane portions SP1, SP2 that are substantially parallel to each other and perpendicular to the longitudinal axis A. Thus, by means of the guide finger 9 and the annular ribs 30, turning the piston 3 relative to the body 2 in a first turning direction R causes the piston 3 successively to more in axial translation relative to the body 2 in a first translation direction T1 along the first sloping portion SI1, then to be axially stationary relative to the body 2 along the first plane portion SP1, then to move in axial translation relative to the body 2 in a second translation direction T2 along the second sloping portion SI2, and then finally to be axially stationary relative to the body 2 along the second plane portion SP2, and so on. The piston 3 thus reciprocates between a high position (cf. FIG. 8) in which the working chamber 31 presents a maximum volume, and a low position in which the working chamber 31 presents a minimum volume. Between the two positions of the piston 3, the working chamber 31 admits and then discharges the fluid.

The piston 3 carries a sealing gasket that is housed in the peripheral groove, and that is made of a material having a modulus of elasticity that is less than the moduli of elasticity of the piston 3 and the body 2. By way of example, it is made of elastomer and is dimensioned so that when the piston 3 is in the cavity 10, the sealing gasket is in contact with the inside wall of the cavity 10.

The sealing gasket is formed of a sealing ring 32 and of a sealing half-ring 33 that are on the same axis and parallel to each other, and that are interconnected by two sealing strips 34. When the piston has only a single longitudinal groove, the sealing gasket comprises only a single sealing strip.

In the embodiment shown, the sealing strips 34 are arranged at 180° from each other. However, the sealing strips 34 may be arranged differently on condition they comply with the geometrical constraints specified below. The sealing strips 34 may have a width that is constant along the longitudinal axis A, or a varying width so as to adapt to a varying width of the channel 22.

The sealing ring 32 is housed in the annular groove 26, the sealing half-ring 33 is housed in the semi-annular groove 27, and each sealing strip 34 is housed in a respective one of the longitudinal grooves 28. Thus, in any angular and axial position of the piston 3 in the body 2, the sealing ring 32 is situated axially beyond the ducts 11, 12 relative to the working chamber 31, the sealing half-ring 33 is situated axially between the ducts 11, 12 and the working chamber 31. The sealing gasket provides sealing around the recessed zone 29, and around the channel 22 and working chamber 31 taken together, thereby guaranteeing fluid-flow communication between the channel 22 and the working chamber 31.

Figure 12:
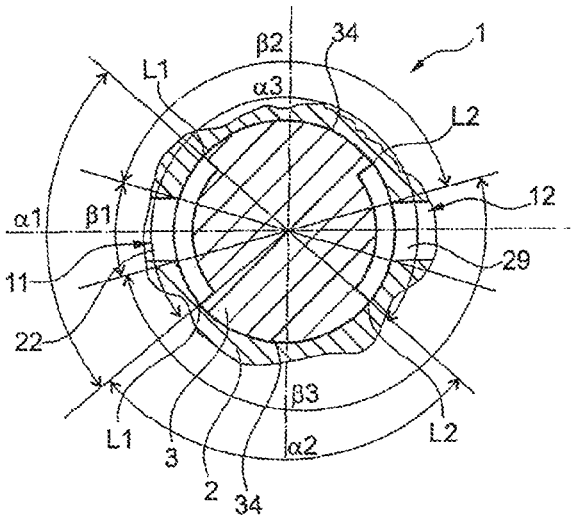
FIG. 12 is a diagrammatic section view from above of the piston and of the body of the first embodiment of the invention, showing the functional angles of the sealing lines of the sealing gasket relative to the positioning and the dimensioning of the ducts. Given the symmetry, only one of each of the angles is shown.
Figure 13:
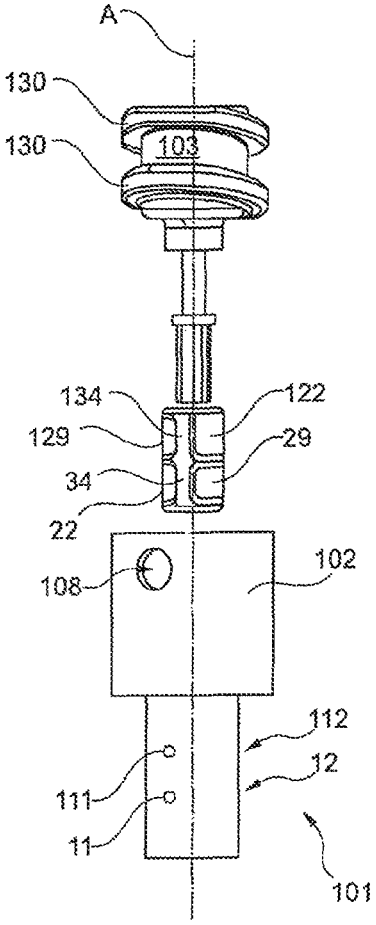
FIGS. 13 and 14 are an exploded perspective view and a cut-away perspective view respectively of a rotary-oscillating sub-assembly in a second embodiment of the invention.
Figure 14:
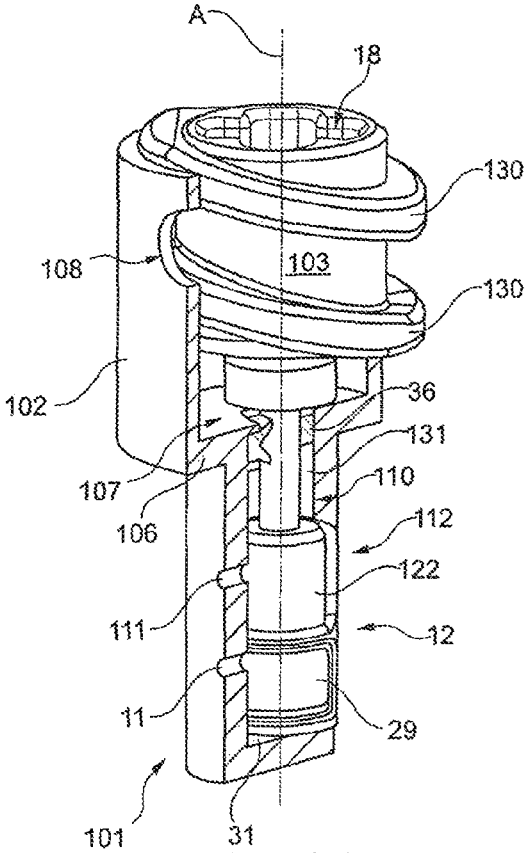

Each sealing strip 34 defines first and second sealing lines L1, L2 (visible in FIGS. 4 and 12) that extend longitudinally and that are offset angularly from each other. As shown in FIG. 12, the channel 22 is thus bordered angularly by the first sealing lines L1 of each of the two sealing strips 34, and the recessed zone 29 is bordered angularly by the second sealing lines L2 of each of the two sealing strips 34. The recessed zone 29 makes it possible to limit the sealing-gasket area in contact with the cavity 10, and thus limit friction. For the same reason, each sealing strip may be recessed, in a variant embodiment not shown.

With reference in particular to FIG. 12, the body 2, the piston 3, and the sealing gasket are arranged so as to comply with the following geometrical constraints:

- the first sealing lines L1 are spaced apart from each other by an angle $\alpha 1$ containing the channel 22, that is greater than each of the angles $\beta 1$ between the edges of either one of the ducts 11, 12, and that is less than each of the angles $\beta 2$ between the adjacent edges of the duct 11 and of its corresponding duct 12;
- each second sealing line L2 is spaced apart from one of the first sealing lines L1 by an angle $\alpha 2$ that does not contain the channel 22, that is less than each of the angles $\beta 2$, and that is greater than each of the angles $\beta 1$;
- the angle $\alpha 3$ between each first sealing line L1 and at least one of the second sealing lines L2, and containing the channel 22, is greater than the angle $\beta 3$ between the axially-opposite edges of the two ducts 11, 12.

The single-acting rotary-oscillating sub-assembly 1 is thus provided with a single stage comprising two ducts 11, 12, a working chamber 31, a channel 22, and a recessed zone 29. Thus, a single channel 22 corresponds to an "intake" and "discharge" pair of ducts 11, 12.

In order to cause the single-acting rotary-oscillating sub-assembly 1 to operate, one of the ducts 11, 12 is connected to a fluid delivery pipe, the other to a discharge pipe for discharging the same fluid, and the piston 3 is mechanically connected, by means of the recessed shape 18, to rotary drive means (not shown) of known type. The operation of the single-acting rotary-oscillating sub-assembly 1 of the invention is described below with reference to FIGS. 6 to 11 and to the graph in FIG. 22.

Figure 6:
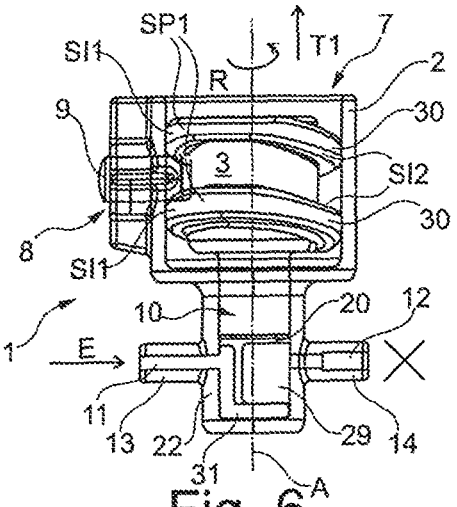
FIGS. 6 to 11 are transparent front views of the rotary-oscillating sub-assembly in the first embodiment of the invention, shown in six distinct operating positions during a pumping cycle (intake, switching, discharge, switching)
Figure 22:
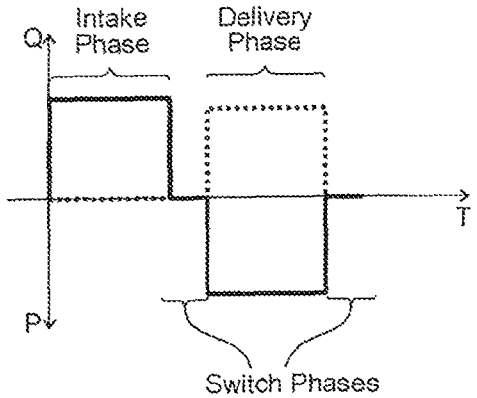
FIG. 22 is a simplified graph showing (by a continuous line) the variation over time of the pressure in the working chamber of a single-acting rotary-oscillating device, and showing (by a dotted line) the flowrate obtained while turning through one complete revolution of the piston. The graph does not show the transition phases, which are described below.

In the intake phase shown in FIGS. 6 and 7 and in the "intake phase" shown in FIG. 22, the guide finger 9 passes mainly along the first sloping portion SI1 of the cam, which transforms the turning movement R of the piston 3 into first movement in translation T1 along a first travel direction of the piston 3 relative to the body 2, which causes the piston 3 to pass from a low position (FIG. 11) in which the working chamber 31 presents a minimum volume, to a high position (FIG. 7) in which the working chamber 31 presents a maximum volume. During the intake phase, the piston 3 turns relative to the body 2, with the channel 22 passing in front of the orifice of the "intake" duct 11. Thus, the "intake" duct 11 is in fluid-flow communication with the working chamber 31 via the channel 22, and the fluid is sucked in by the increase in the volume of the working chamber 31 caused by the first movement in translation T1, thereby creating suction in the working chamber 31 along arrow E. During the intake phase, the recessed zone 29 passes in front of the orifice of the "discharge" duct 12. The sealing gasket seals the "discharge" duct 12 which is not in fluid-flow communication with the working chamber 31, and this is represented by a cross. Thus, during the intake phase via the "intake" duct 11, the fluid does not leave the working chamber 31 via the "discharge" duct 12. The piston 3 continues to turn R relative to the body 2 until a first switching phase is reached. In advantageous manner, at the start of the intake phase, during a transition phase, the guide finger 9 passes over the end of the second plane portion SP2. In addition, at the end of the intake phase, during a transition phase, the guide finger 9 passes over the start of the first plane portion SP1 of the cam. Thus, the transition phases occur while the volume of the working chamber 31 is constant. For simplification purposes, the transition phases are not shown on the graph in FIG. 22.

Figure 8:
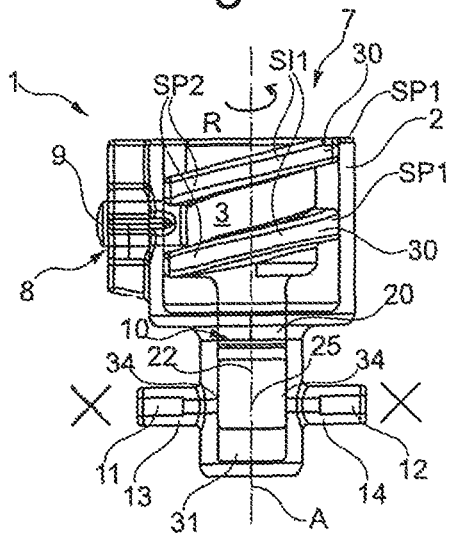

In the first switching phase shown in FIG. 8 and in one of the "switch phases" shown in FIG. 22, the guide finger 9 passes along the first plane portion SP1 of the cam. The piston 3 turning R thus does not cause it to move in translation, and the piston 3 is axially stationary in its high position. Thus, the volume of the working chamber 31 does not vary and remains at its maximum. During the switching phase, each of the orifices of the "intake" and "discharge" ducts 11, 12 faces a respective one of the sealing strips 34 that prevent any fluid-flow communication with one or the other of the "intake" or "discharge" ducts 11, 12. Thus, the working chamber 31 is closed in leaktight manner. The piston 3 continues to be turned R relative to the body 2 until the discharge phase is reached.

Figure 9:
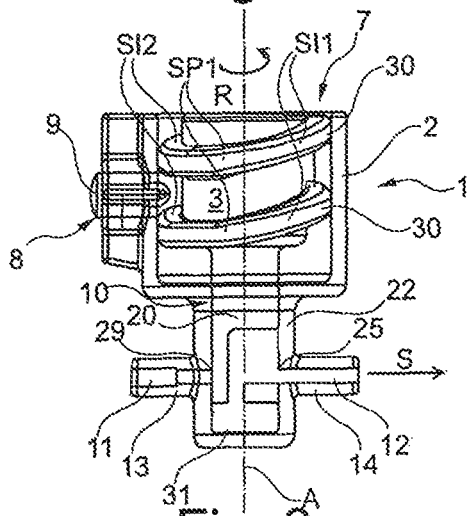
Figure 10:
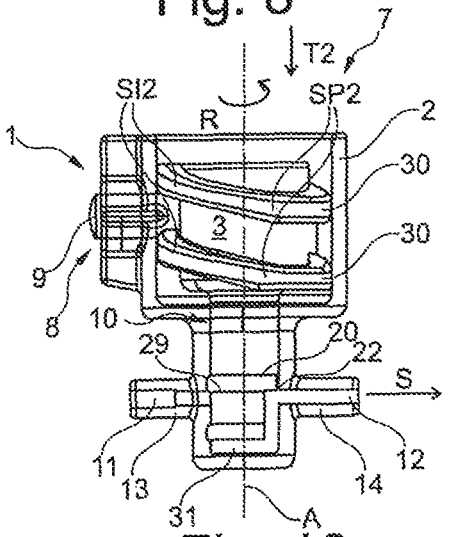
Figure 11:
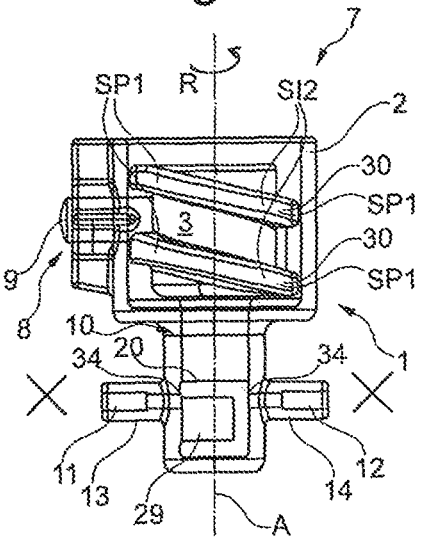

In the discharge phase shown in FIGS. 9 and 10 and in the "discharge phase" shown in FIG. 22, the guide finger 9 passes mainly along the second sloping portion SI2 of the cam, which transforms the turning R of the piston 3 into a second movement in translation T2 along a second travel direction that is opposite to the first travel direction during the movement in translation T1. Thus, the piston 3 passes from its high position (FIG. 8) to its low position (FIG. 11). During the discharge phase, the piston 3 turns relative to the body 2, with the channel 22 passing in front of the orifice of the "discharge" duct 12. Thus, the "discharge" duct 12 is in fluid-flow communication with the working chamber 31 via the channel 22, and the fluid is discharged via the "discharge" duct 12 along arrow S by the decrease in the volume of the working chamber 31 caused by the second movement in translation T2 and creating higher pressure in the working chamber 31. During the discharge phase, the recessed zone 29 passes in front of the orifice of the "intake" duct 11. The sealing gasket seals the "intake" duct 11 which is not in fluid-flow communication with the working chamber 31. Thus, during the phase of discharge via the "discharge" duct 12, the fluid does not enter the working chamber 31 via the "intake" duct 1. The piston 3 continues to be turned R relative to the body 2 until a second switching phase is reached. In advantageous manner, at the start of discharge, during a transition phase, the guide finger 9 passes over the end of the first plane portion SP1. In addition, at the end of the discharge phase, during a transition phase, the guide finger 9 passes over the start of the second plane portion SP2 of the cam. Thus, the transition phases occur while the volume of the working chamber 31 is constant. For simplification purposes, the transition phases are not shown on the graph in FIG. 22.

This second switching phase shown in FIG. 11 and in the other "switch phase" shown in FIG. 22 is substantially similar to the first switching phase. It differs therefrom in that the piston 3 is in the low position, the working chamber 31 presents a minimum volume, and the position of the sealing strips 34 relative to the "intake" and "discharge" duets 11, 12, is inverted relative to the first switching phase.

The rotary-oscillating cycle may be repeated. Naturally, depending on the direction of turning of the piston 3 relative to the body 2, the "intake" duct could correspond to the discharge duct and vice versa. During movements of the piston 3 in the cavity 10, contact between the balancing lug 25 and the wall of the cavity 10 prevents the piston 3 from sloping relative to the longitudinal axis A which would cause an increase in friction, the appearance of leaks, or even jamming of the piston 3 in the body 2.

By modifying the profiles of the first and second sloping portions SI1, SI2 and the positioning of the first and second sealing lines L1, L2, the ratio between the intake phase and the discharge phase may be adjusted. The duration of one of the intake and discharge phases may thus be extended relative to the duration of the other.

The rotary-oscillating sub-assembly 101 in the second embodiment of the invention is shown in FIGS. 13 to 20 and presents a double-acting configuration. To this end, it comprises two stages, a first stage similar to the stage of the rotary-oscillating sub-assembly 1, and a second stage comprising two ducts 111, 112, a working chamber 131, a channel 122, a recessed zone 129 like those of the first stage. Thus, a single channel 22, 122 corresponds to each pair of "intake" and "discharge" ducts 11, 12.

Figure 15:
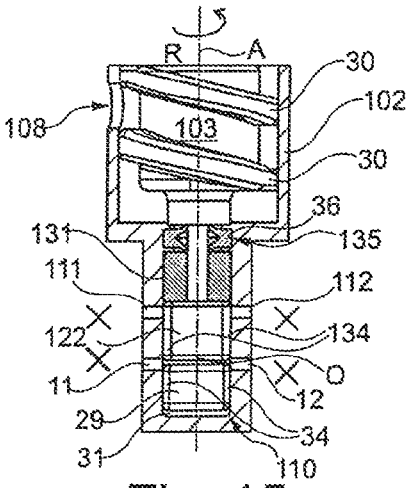
FIGS. 15 to 20 are section views of the rotary-oscillating sub-assembly in FIGS. 13 and 14, shown in six distinct operating positions during a pumping cycle. The guide finger is not shown in the figures.
Figure 16:
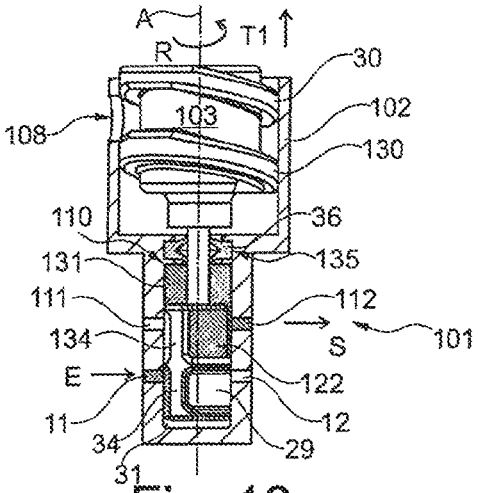
Figure 17:
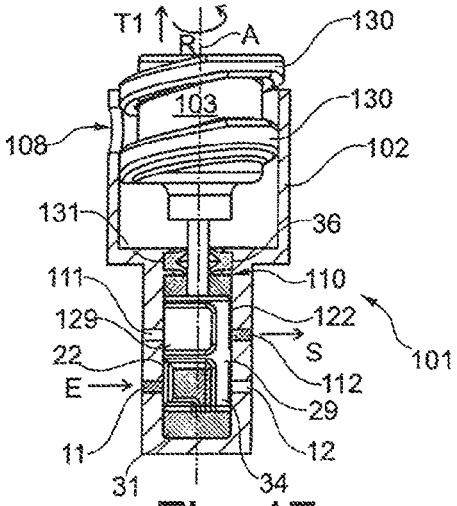
Figure 18:
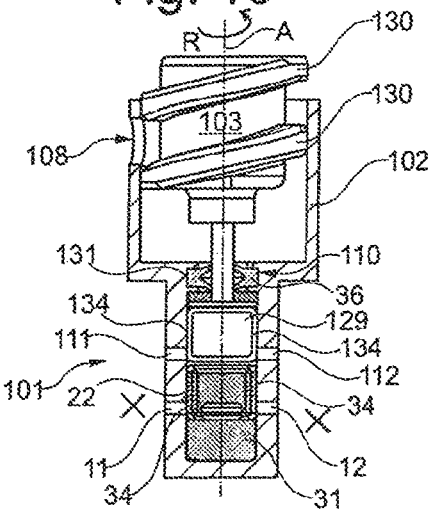
Figure 19:
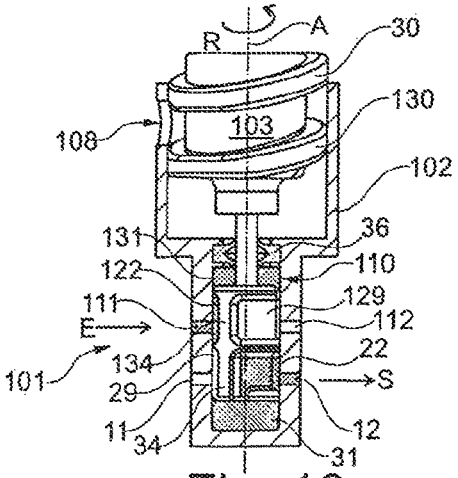
Figure 20:
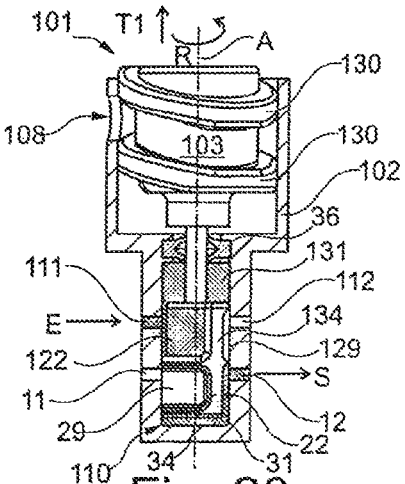
Figure 23:
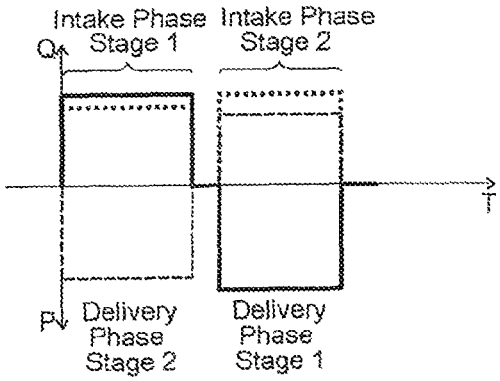
FIG. 23 is a simplified graph showing (by continuous and dotted lines) the variation over time of the pressure in each of the working chambers of a double-acting rotary-oscillating device, and showing (by a dotted line) the flowrate obtained while turning through one complete revolution of the piston. The graph does not show the transition phases, which are described below.

In the embodiment shown, the "intake" ducts 11, 111 are superposed longitudinally, the "discharge" ducts 12, 112 are superposed longitudinally, the channels 22, 122 are situated at 180° from each other, and the recessed zones 29, 129 are situated at 180° from each other. The fluid-flow connections via the "intake" ducts 11, 111 and the "discharge" ducts 12, 112 are at 180°. The body 102 includes a cavity 110 that presents a greater height longitudinally, thus making it possible to house both stages. The body 102 also includes an annular furrow 135 that is coplanar with the shoulder 106 separating the cavity 110 and the bore 107, that is oriented towards the inside of the body 102, and that is for receiving an additional sealing gasket 36, for example, or for receiving any other sealing element that provides sealing between the piston 103 and the body 102. Thus, as shown by the graph in FIG. 23, when one stage is in the "intake phase" with the channel 22, 122 facing the "intake" duct 11, 111, the other stage is in the "discharge phase" with the channel 22, 122 facing the "discharge" duct 12, 112 (FIGS. 16, 17, 19, and 20). Like the rotary-oscillating sub-assembly 1, during the switching phases, the "intake" ducts 11, 111 and the "discharge" ducts 12, 112 are closed in leaktight manner (FIGS. 15 and 18).

In a first configuration, the "intake" ducts 11, 111 of each stage may be in fluid-flow connection with a common inlet for a single fluid, and the "discharge" ducts 12, 112 of each stage may be in fluid-flow connection with a common outlet of a single fluid.

In a second configuration, the double-acting rotary-oscillating sub-assembly may advantageously be used to create mixtures by using one stage for a first fluid and another stage for a second fluid, the "discharge" ducts 12, 112 of each stage being connected to a single container for receiving the resulting mixture. By modifying the ratio between the working chambers 31, 131 and possibly the sections of the ducts 11, 111, 12, 112, it is possible to vary the dosage of the resulting mixture.

In these two configurations, the flowrate of the pumping device incorporating such a double-acting rotary-oscillating sub-assembly 101 is increased, with a pulsation frequency that is twice that of a single-acting rotary-oscillating sub-assembly 1.

In a third configuration, the "discharge" duct 12 of one stage may be in fluid-flow connection with the "intake" duet of the other stage. In the third configuration, the sucked-in fluid passes through both working chambers 31, 131 in succession. The discharge pressures generated by each stage of the stages can thus be summed in cascade.

In a fourth configuration, the two stages may be identical and merely offset from each other longitudinally. Thus, the two intake phases of the two stages coincide, and the two discharge phases of the two stages coincide. In this configuration, the flow rate of the pumping device incorporating such a double-acting rotary-oscillating sub-assembly 101 is doubled, with a pulsation frequency that is identical to that of a single-acting rotary-oscillating sub-assembly 1.

In another embodiment (not shown), each "intake" duct is offset angularly from the corresponding "discharge" duct by a predetermined angle, the channels are offset angularly from each other by the same predetermined angle and the recessed zones are also offset angularly by the same predetermined angle. The fluid-flow connections via the "intake" and "discharge" ducts are in distinct longitudinal planes that are angularly offset by the predetermined angle. The angle may be selected to facilitate the three-dimensional organization of the fluid-flow connections. This embodiment may be combined with the various configurations described in detail above.

The invention makes it possible to achieve the above-mentioned objects. Specifically, the rotary-oscillating sub-assembly 1, 101 of the invention is simple to manufacture with a limited number of parts. The sealing gasket makes it possible to limit the geometrical constraints to be complied with, and to make it easier to manufacture the rotary-oscillating sub-assembly 1, 101. It is easier to assemble, and the recessed zone 29, 129 makes it possible to improve its energy efficiency.

The rotary-oscillating sub-assembly 1, 101 makes it possible to guarantee a flowrate that is accurate, regardless of the user and/or of the viscosity of the fluid. It may be coupled with an angular-position sensor.

In addition, the rotary-oscillating sub-assembly 1, 101 of the invention is reversible, by merely reversing the direction in which the piston 3, 103 is turned. Thus, the "intake" duct 11, 111 becomes the "discharge" duct 12, 112 and vice versa. The mechanical uncoupling between the piston 3, 103 and the drive means make it possible to obtain a disposable rotary-oscillating sub-assembly while the motor portion is reusable. It is thus possible to guarantee that the rotary-oscillating sub-assembly 1, 101 is sterile at lower cost by replacing it between two uses. Thus, only the fluid-flow portion of the rotary-oscillating pumping device is renewed, the motor and control portions being conserved between two uses. Since the axial forces are transmitted by the cam, it is possible to use drive means that are rotary only, and to use mechanical coupler means between the piston 3 and the drive means that transmit only torque. In addition, the cam makes it possible to guarantee that the oscillating movement in translation of the piston 3 is synchronous with turning of that piston 3.

The rotary-oscillating sub-assembly 1, 101 of the invention prevents any fluid flow with the "intake and discharge" ducts 11, 111, 12, 112 during the switching phases, but without creating the effect of excess pressure or suction by hydraulic blocking during these phases. Furthermore, it makes it possible to limit dead volume.

The contact between the sealing gasket and the body makes it possible to set the position of the rotary-oscillating sub-assembly 1, 101 angularly in the factory during its initial assembly. The angular setting is thus easily conserved until the rotary-oscillating sub-assembly 1, 101 is put into service in the rotary-oscillating device. Nevertheless, it is possible to provide a visible mark of the angular position of the piston 3, 103 relative to the body 2, 102, or a sensor of any suitable technology.

Naturally, the present invention is not limited to the above description of an embodiment, and it may be subjected to various modifications without going beyond the ambit of the invention.

What is claimed is:

1. A rotary-oscillating sub-assembly for positive displacement pumping of a fluid, said sub-assembly comprising:

a hollow body defining a cylindrical cavity having a longitudinal axis and a wall with at least two ducts passing therethrough and opening out radially into said cavity;

a piston housed in said cavity so as to define a working chamber with said cavity, the piston having an outside cylindrical surface with a longitudinal channel or recess that opens out longitudinally into said working chamber, said piston having a sealing gasket that is made of a material having a modulus of elasticity that is less than moduli of elasticity of said piston and of said body, the gasket positioned beside said channel so as to form a seal between said piston and said cavity, the piston movable angularly relative to the body and thereby configured to put said working chamber into sequential fluid-flow communication with at least one duct of the two ducts, then no duct, then at least the other of said two ducts when said piston is moved angularly relative to the body, said piston also movable in longitudinal translation relative to the body so as to reciprocate relative to the body and thereby configured to cause a volume of said working chamber to vary and successively suck in and then discharge said fluid via one of said two ducts, then the other of said two ducts when said piston is moved in longitudinal translation relative to the body, wherein the piston includes a first axial end remote from a second axial end, said second axial end being in contact with the working chamber;

said sealing gasket having a plurality of portions comprising: a first sealing portion in the shape of a ring that extends around the cylindrical surface of the piston beside a first axial end of the sealing gasket; a second sealing portion in the shape of a half-ring that extends around the cylindrical surface of the piston beside a second axial end of the sealing gasket, the half-ring having two ends that are spaced apart from each other over a cylindrical periphery of the piston; and a third sealing portion that is formed by two sealing strips that extend axially over the outside surface of the piston respectively between a first end of the half-ring and the ring, and between a second end of the half-ring and the ring;

wherein the two strips are angularly spaced from each other and each defines a first sealing line and a second sealing line:

wherein the first sealing line of one of the two strips angularly borders said channel, wherein said first sealing lines are spaced apart from each other by an angle containing said channel, said angle greater than each angle between the opposite edges of either one of the at least two ducts, and said angle less than each angle between the adjacent edges of either one of the at least two ducts and the other of the at least two ducts;

wherein each second sealing line is spaced apart from one of said first sealing lines by an angle that does not contain said channel, said angle less than each angle between the edge of one duct of the at least two ducts and the adjacent edge of the corresponding duct, and said angle greater than each angle between the opposite edges of either one of the at least two ducts; and wherein an angle between each first sealing line from at least one of the second sealing lines, and containing said channel, is greater than an angle between axially-opposite edges of the at least two ducts.

2. The rotary-oscillating sub-assembly according to claim 1, wherein said piston includes a peripheral groove that receives said sealing gasket, which peripheral groove is formed of at least one annular groove that receives said first sealing portion, a semi-annular groove that receives said second sealing portion, and a longitudinal groove that interconnects said annular groove and said semi-annular groove and that receives said third sealing portion.

3. The rotary-oscillating sub-assembly according to claim 2, wherein at least one of said sealing portions and annular channel extends longitudinally beyond said channel relative to said working chamber and beyond said ducts relative to said working chamber, and wherein at least one of said second sealing portion and semi-annular groove extends longitudinally at an end of said channel opening out into said working chamber and between said ducts and said working chamber.

4. The rotary oscillating sub-assembly according to claim 2, wherein, in its periphery, said piston includes at least one closed recessed zone that is entirely surrounded by said sealing gasket, said recessed zone extending angularly so as to be facing one of the ducts when said channel is facing another duct, said longitudinal groove being formed of two arms, each extending between said channel and said recessed zone, and in that each arm receives one of said two strips so as to isolate said recessed zone from said channel in leaktight manner, in any longitudinal and angular position of said piston in said body.

5. The rotary-oscillating sub-assembly according to claim 4, wherein said recessed zone extends over an angle that is less than each of the angles between adjacent edges of either one of the ducts and of its corresponding duct.

6. The rotary-oscillating sub-assembly according to claim 1, wherein said piston includes at least one balancing lug that is provided in said channel and that extends radially so that its periphery bears against said cavity while allowing fluid to pass over its sides.

7. The rotary-oscillating sub-assembly according to claim 1, wherein the wall of the hollow body has four ducts, the first two ducts forming a first stage and the third and fourth ducts forming a second stage.

8. The rotary-oscillating sub-assembly according to claim 1, wherein the rotary-oscillating sub-assembly includes at least a cam and a guide finger, either the cam or the guide finger carried by said piston, the other by said body, and arranged to co-operate reciprocally so that turning said piston relative to said body causes:

over a first angular portion, said piston to move in axial translation relative to said body in a first direction;

over a second angular portion, said piston to be axially stationary relative to said body;

over a third angular portion, said piston to move in axial translation relative to said body in a second direction;

over a fourth angular portion, said piston to be axially stationary relative to said body;

said ducts, said sealing gasket, and said channel being arranged so that said ducts are closed during said second and fourth angular portions.

9. A rotary-oscillating device for positive displacement pumping of a fluid, wherein the device comprises drive means and a rotary-oscillating sub-assembly for positive displacement pumping of a fluid according to claim 1, and releasable mechanical coupler means for mechanically connecting said drive means to said piston in a releasable manner.

* * * * *